United States Patent [19]

Bjorlund

[11] 3,989,351

[45] Nov. 2, 1976

[54] REFLECTION DEVICE

[76] Inventor: John Bjorlund, Sodra vagen 68B, 412 54 Goteborg, Sweden, 41254

[22] Filed: Dec. 10, 1974

[21] Appl. No.: 531,333

[30] Foreign Application Priority Data

Dec. 14, 1973 Sweden ..... 7316892

[52] U.S. Cl. ..... 350/97; 350/103; 350/102

[51] Int. Cl.[2] ..... G02B 5/12

[58] Field of Search ..... 350/97, 103, 105, 106, 350/318; 404/13, 14, 15, 16

[56] References Cited

UNITED STATES PATENTS

| | | | |
|---|---|---|---|
| 2,241,596 | 5/1941 | Guhl | 350/58 |
| 3,551,024 | 12/1970 | Priest, Jr. | 350/106 X |
| 3,796,477 | 3/1974 | Geraci | 350/318 X |
| 3,802,378 | 4/1974 | Kessler | 350/97 X |

*Primary Examiner*—John K. Corbin
*Assistant Examiner*—B. Wm. de los Reyes
*Attorney, Agent, or Firm*—Holman & Stern

[57] ABSTRACT

The invention provides an improved reflection device comprising a tubular means enclosing a reflective element and arranged for mounting at desired level over a road surface at some distance from the road border. In the preferred embodiment, the tubular means has two open ends, and the reflective element has reflective material at both sides thereof and is arranged for being detachably inserted through a slot in the envelope wall of the tubular means. For eliminating or decreasing the risk of soiling the reflective element, said element is protected by the tubular means which has portions of substantial length in front of both sides of the reflective element. Preferably, each of said portions have a length of at least equal to half the internal maximum cross section dimension of the tubular means at the location of the reflective element. The reflective element is provided with a grip and is easily insertable and removable into and out from said slot. The slot is preferably converging towards the open end thereof. The tubular means can be moulded of plastic material integrally with an attachment flange for mounting said tubular means to a support rod.

4 Claims, 5 Drawing Figures

REFLECTION DEVICE

BACKGROUND OF THE INVENTION

Undoubtedly, reflection posts have substantial advantages as optical guiding means when driving in the dark on a road. Such posts are commonly used in most countries.

The inventor of the present invention has made an investigation of optical guiding system for roads. The investigation was made as a report for achieving a Degree in Management at the University of Gothenburg and led to a number of results, of which the following are the most important:

1. Reflection posts are efficient and economically justified optical road guiding instruments.

2. No matter which direction the driver drives his vehicle, it should be possible for him to utilize the reflection posts at both road margins. These except being able to see the reflection elements at the side of the road used by the driver, it should also be possible for him to see the reflection elements at the other side of the road. Therefore, there should be reflecting surfaces at both sides of reflection posts of this kind.

3. The reflection ability is improved if the continuous reflection area of the reflection device is increased. For optimizing the utilization of available space, circular form of the reflection surfaces is preferably used (the minimum area of a reflection surface should be at least 12.5 $cm^2$).

4. On "common roads", the spacing between the reflection devices or posts should be approximately 33 m, and on expressways the distance between posts should be approximately 50 m. The distance from the road border should be approximately 0.5 m.

5. Due to the climate in many countries, the reflection elements are adversely affected by dirt or soiling. Dirt decreases the reflection ability, and the necessary cleaning implies costs.

6. However, the investigation discloses that considerable saving of costs can be obtained if the reflection elements are detachable from the reflection devices or reflection posts, so that the reflection elements can be cleaned separately.

Thus, there is a need for a reflection device or reflection post giving reflection effect in both driving directions, preventing or substantially preventing or delaying soiling of the reflection surfaces and being so arranged that it is detachable from the reflection device or reflection post for making possible a cleaning if necessary.

SUMMARY OF THE INVENTION

The main object of the invention is to fulfill said need and provide a reflection device which comprises a tubular means supporting a fully or partially reflecting element, said tubular means being arranged for mounting at the desired level above a road surface or similar, so that the reflecting element is visible through at least one open end of the tubular means. The particular features of said reflection device consist in that at least a portion of said element extends outwardly from an opening in the limiting wall or envelope wall of the tubular means, said opening being arranged for inserting and removing the element into and out from the tubular means, respectively; and in that the tubular means has a portion of substantial length located in front of said element in a direction towards the open end of the tubular means.

Of course, in the primary application seen for the invention, the tubular means has two open ends. From what just has been mentioned concerning the reflection device, it is seen that the following conditions are met:

1. The reflection device can be discovered from two directions.

2. The reflection device protects against, or at least delays or makes soiling more difficult.

3. The reflection device is detachable for making the cleaning easier to carry out.

The condition 1 is met in that, in the preferred embodiment, the tubular device has two open ends and in that the reflecting element is provided with reflecting material at both sides thereof. The condition 2 is met in that the reflecting element is located in the tubular means in such a way that there are portions of substantial length of said tubular means directed towards the open ends thereof. Preferably, each of said portions have a length of at least equal to half the internal maximum cross section dimension of the tubular device at the location of the reflecting element. The condition 3 is met in that said opening is provided in the tubular means.

DESCRIPTION OF PRIOR ART

The U.S. patent specification No. 3,091,997 discloses a reflection device where a reflecting disc is enclosed within a cylindrical portion. The reflecting material is protected by outer discs which are detachable, but not in such a simple way that this feature can be used in the present invention. Besides, FIGS. 6 and 7 of said patent specification show that the portions of the cylindrical tube located in front of the deflecting disc are relatively short and are to be regarded as flanges or attachments only.

Further on, the Swiss patent specification No. 514,908 discloses a reflection disc which in the direction of the reflected light rays is enclosed by an optical refraction device for focusing the light onto the reflecting material. The problem solved by the invention does not exist in said device, and the three conditions given above are therefore of course not met.

For further illustrating prior art, reference is made to the Swedish patent specifications 308,130, 349,344 and 301,168; German "Offenlegungsschrift" 2,137,334; and the U.S. patent specification No. 3,212,415.

In spite of the fact that a great number of different reflection devices previously have been developed, a simple reflection device of the kind suggested according to the invention has not existed.

BRIEF DESCRIPTION OF THE DRAWING

For further illustrating the invention, preferred embodiments thereof will now be described with reference to the accompanying drawing.

DESCRIPTION OF PREFERRED EMBODIMENTS

Figure 1:
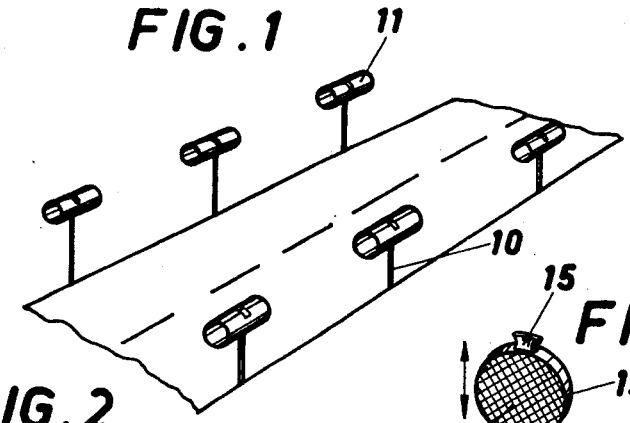
FIG. 1 shows schematically a road surface where reflection devices according to one embodiment of the invention are mounted along the border of the road.
Figure 3:
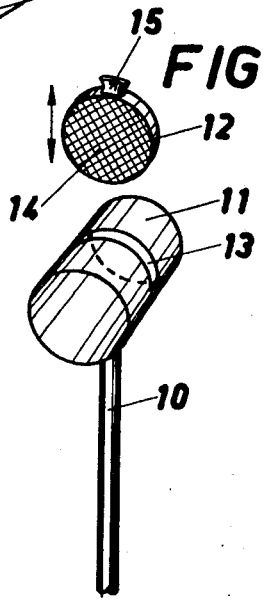
FIG. 3 shows the reflection device when the reflecting element has been removed from the tubular means.

As is disclosed in FIG. 1, ordinary straight posts 10 are vertically arranged along the borders of the road, and on the tops of the rods there are arranged tubular means 11 enclosing reflecting elements 12 (FIG. 3).

Figure 2:
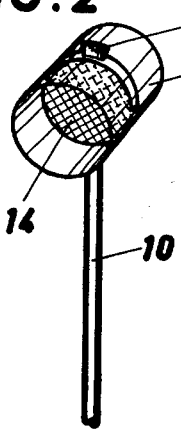
FIG. 2 shows the reflection device when the reflecting element has been inserted in the tubular means.

In the embodiment of the invention shown in FIGS. 1 – 3, the tubular means 11 comprises a tube arranged horizontally in the direction of the road surface and perpendicularly to the post 10. If the tube is cylindrical, as shown on the drawing, the length of the tube should be longer than the diameter of the tube. Alternatively, the tubular means can be differently shaped. For instance, it can be slightly funnel shaped from both ends, i.e. from the outside towards the mid portion, or can have other shape. For mounting the tube 11 on the rod 10 there is an annular flange (not shown) at the bottom side (FIGS. 2 and 3) of the tube at the mid portion thereof. At the top side mid portion of the tube 11 there is a slot 13 arranged perpendicularly to the longitudinal direction of the tube, and the slot extends from the upper portion of the envelope surface of the tube 11 a distance corresponding to approximately half the circumference of the tube, so that the reflection disc or the reflective element 12 can be inserted. In the embodiment shown, the reflective portion 14 of said reflection disc 12 occupies the entire internal space of the tubular means perpendicularly to the longitudinal direction thereof. On both sides of the reflective element 12 there are reflective surfaces 14.

The reflecting element or reflection disc 12 has substantially the same thickness as the width of the slot, and the area of each reflective surface 14 correspond to the internal area of the tube 11 in a section perpendicularly to the axis thereof.

Also, the reflective element 12 is so designed that it easily can be removed from the tubular means. As schematically shown in the figures, there is a handle or grip 15 on the disc 12.

In summary, it is noted that the reflection device described can be observed from two directions, the reflection disc can easily be removed and washed. Further on, it is noted that soiling is substantially decreased and that the time intervals between cleaning will be considerably increased due to the protective function of the tubular means or reflection element support 11.

Figure 4:
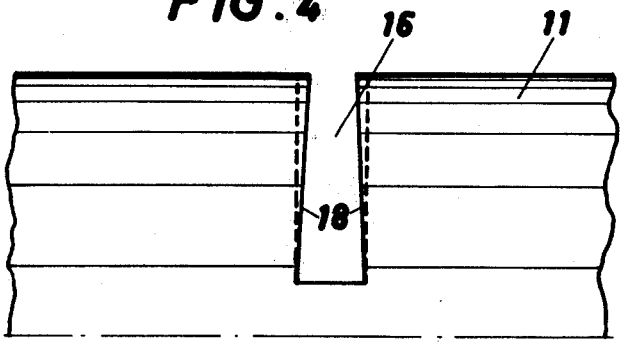
FIG. 4 is a partial elevation view showing in the tubular means the slot used for inserting the reflecting element.

The tubular means and the rod are preferably made of plastic material. If the material has a certain degree of resilience, a slot 16 of the kind shown in FIG. 4 can be used for detachably mounting the reflection disc 12 to the tube. As shown by solid lines in FIG. 4, the slot is tapering towards the open end of the slot. By dashed lines the position of the slot limiting surfaces 18 is shown when a reflection disc 12 has been inserted in the slot.

Figure 5:
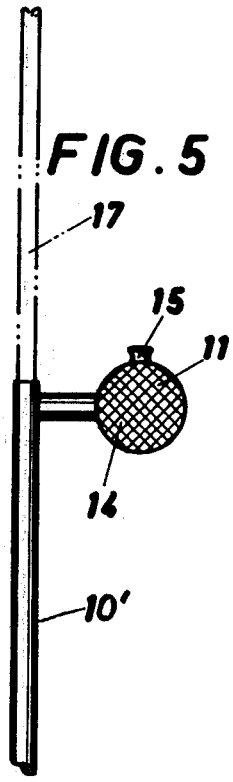
FIG. 5 shows an alternative embodiment of a rod used for supporting the tubular means.

In FIG. 5 there is shown an alternative embodiment of a rod for supporting the tube and the reflection disc. The vertical portion 10 of the rod can here be used for supporting a further rod 17 of the kind used for marking the road margins in places where large amounts of snow can be expected.

What I claim is:

1. A reflective road marker comprising an elongated tubular means for removably supporting a reflecting element; means on said tubular means for mounting the tubular means at a desired level horizontally disposed over a road surface or similar surface so that said reflecting element is visable through opposite ends of said tubular means, the improvement wherein said tubular means includes an intermediate, transverse slot normal to the longitudinal axis thereof and opening into the outer surface of said tubular means; and a reflecting element having opposite reflecting surfaces, removably disposed in said slot, said tubular means having portions at opposite sides of said reflecting element of a length at least substantially equal to half the maximum internal cross-section of said tubular means at the location of the reflecting element, the portions of said tubular means at opposite sides of said reflecting element comprising through passages at which the reflecting surfaces of the reflecting element are exposed; said slot in the tubular means having a width substantially equal to the thickness of said reflecting element, said slot tapering from a medial portion of said tubular means toward the outer surface therefor for grippingly engaging opposite sides of said reflecting element.

2. The reflective road marker according to claim 1, wherein said tubular means is symmetric along the longitudinal axes thereof.

3. The reflective road marker according to claim 1, wherein said tubular means is cylindrical in cross-section and where the portions of the tube located towards the open ends of the tube each have a length substantially equal to half the internal diameter of the tube.

4. The reflective road marker according to claim 3, wherein said slot is perpendicular to the mid portion of the cylindrical tube and along half the circumference of the tube, said slot having at the base portion thereof a width substantially equal to the thickness of the reflecting element.

* * * * *